US006391254B1

(12) United States Patent
Ono

(10) Patent No.: US 6,391,254 B1
(45) Date of Patent: May 21, 2002

(54) FE-CR-NI ALLOY FOR ELECTRON GUN ELECTRODES

(75) Inventor: Toshiyuki Ono, Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/609,817

(22) Filed: Jul. 3, 2000

(30) Foreign Application Priority Data

Jul. 5, 1999 (JP) ..... 11-190280

(51) Int. Cl.[7] ..... C22C 38/40; C22C 38/44; C22C 38/46; C22C 38/48; C22C 38/50

(52) U.S. Cl. ..... 420/43; 420/54; 148/327

(58) Field of Search ..... 420/43, 52, 53, 420/54; 148/327

(56) References Cited

FOREIGN PATENT DOCUMENTS

| | | | |
|---|---|---|---|
| JP | 362272427 A | * | 11/1987 |
| JP | 8-092691 | | 4/1996 |
| JP | 10-030157 | | 2/1998 |
| JP | 11-106873 | | 4/1999 |
| JP | 411106873 A | * | 4/1999 |

* cited by examiner

*Primary Examiner*—Deborah Yee
(74) *Attorney, Agent, or Firm*—Arent, Fox, Kintner, Plotkin & Kahn, PLLC

(57) ABSTRACT

An Fe—Cr—Ni alloy for electron gun electrodes comprises: 15 to 20% Cr; 9 to 15% Ni; 0.12% or less C; 0.005 to 1.0% Si; 0.005% to 2.5% Mn; 0.03% or less P; 0.0003 to 0.0100% S; 2.0% or less Mo; 0.001 to 0.2 % Al; 0.003% or less O; 0.1% or less N; 0.1% or less Ti; 0.1% or less Nb; 0.1% or less V; 0.1% or less Zr; 0.05% or less Ca; 0.02% or less Mg; and the balance Fe and inevitable impurities by weight, and the alloy has a surface roughness satisfying the following formula in defining kurtosis in the rolling direction and kurtosis in the transverse direction to the rolling direction in surface roughness of the alloy as respectively $Kr_0$ and $Kr_{90}$ $$Kr_0 \leqq 4,\ Kr_{90} \leqq 4$$

7 Claims, No Drawings

FE-CR-NI ALLOY FOR ELECTRON GUN ELECTRODES

BACKGROUND OF THE INVENTION

This invention relates to an Fe—Cr—Ni alloy which is required to be nonmagnetic and is used in electron gun electrodes, and specifically relates to an alloy with improved press forming properties for drawing.

In general, electron gun electrodes used in color picture tubes and the like are produced by drawing a nonmagnetic Fe—Cr—Ni stainless steel material with a thickness of 0.05 to 0.5 mm into a predetermined shape using press forming. In order to improve the formability for drawing, in particular, to facilitate burring (working in which a circular hole is formed and the circumference thereof is projected like a cylinder), improvement in degree of rolling reduction and annealing conditions has been proposed in Japanese Patent Application, First Publication, No. 257253/94. Japanese Patent Application, First Publication, No. 205453/96 proposes a method in which press forming properties are improved by limiting center line average height and maximum height of surface roughness in press forming using a low viscosity lubricating oil, which is easy to degrease and has been used to increase production efficiency. Japanese Patent Application No. 283039/97 demonstrates that burrs remaining in press punching a through hole relates to cracks in burring, and proposes a method in which burring properties are improved by suitable amounts of S being contained to improve punching properties and minute amounts of the elements are controlled to improve the formability for drawing.

According to the rapid advances of finer and brighter picture tubes for computers in recent years, requirements on focusing characteristics of the electron guns has become more severe. Therefore, the requirement on materials is necessary to have not only high precision formability for the large lens diameter electrodes but also good formability for high speed press forming. As a result, the prior art alloys have not been adequate since cracks occur on drawing surfaces.

BRIEF SUMMARY OF THE INVENTION

The present invention has been made to complete the above situation. An object of the invention is to provide an Fe—Cr—Ni alloy for electron gun electrodes, having superior formability for drawing, which has been more severe in recent years, in particular, having superior surface qualities after drawing.

The inventors have extensively studied the surface conditions of materials to complete the problems. As a result, the inventors have found that the formability for drawing is influenced by the degree of sharpness of projections in surface profile. In particular, the inventors have found that the formability for drawing is inferior and surface cracks in drawing readily occur when the ends of the projections are sharp and the intermediate portion (valley) between the projections is deep and steep. In particular, it has been estimated that cracks would surely occur when the valley is deep and steep and when foreign particles such as inclusions are present at the bottom of the valley. The inventors have made the invention by representing the degree of the sharpness of the projections by kurtosis Kr and analyzing the relationship between the kurtosis Kr and the formability for drawing. The kurtosis Kr is represented by the following formula (1).

$$Kr=\Sigma(Y_i/R_q)^4/N \quad (1)$$

Wherein $y_i$ is roughness profile, $R_q$ is root mean square roughness, and N is number of samples.

This invention provides an Fe—Cr—Ni alloy for electron gun electrodes comprising: 15 to 20% Cr; 9 to 15% Ni; 0.12% or less C; 0.005 to 1.0% Si; 0.005% to 2.5% Mn; 0.03% or less P; 0.0003 to 0.0100% S; 2.0% or less Mo; 0.001 to 0.2% Al; 0.003% or less O; 0.1% or less N; 0.1% or less Ti; 0.1% or less Nb; 0.1% or less V; 0.1% or less Zr; 0.05% or less Ca; 0.02% or less Mg; and the balance Fe and inevitable impurities by weight, and the alloy having a surface roughness satisfying the following formula (2) when kurtosis in the rolling direction and kurtosis in the transverse direction to the rolling direction in surface roughness of the alloy are respectively defined as $Kr_0$ and $Kr_{90}$.

$$Kr_0 \leqq 4,\ Kr_{90} \leqq 4 \quad (2)$$

The reasons for the above limitations in the surface roughness and the alloy composition in the Fe—Cr—Ni alloy for electron gun electrodes will be explained together with the effects of the present invention. In the following explanation, "%" means "weight %".

($Kr_0$, $Kr_{90}$): The above-mentioned kurtosis range has been found by the inventors performing quantity analysis. According to the research by the inventors, if $Kr_0$ and $Kr_{90}$ are more than 4, a large number of high ridges and deep valleys with very sharp shapes exist in the surface roughness profile, and as a result, cracks occur on the drawn surface. Therefore, $Kr_0$ and $Kr_{90}$ are restricted to 4 or less.

(Cr): Electron gun electrodes are essentially required to be nonmagnetic. Normally, permeability is required to be 1.005 or less for them to be nonmagnetic. In order to meet the requirement, the content of Cr is restricted to within the range of 15 to 20%. A more preferable range for the Cr content is from 15 to 17%.

(Ni): If the Ni content is less than 9%, magnetic characteristics increase. If the Ni content exceeds 15%, the material cost increases too much. Hence, the Ni content is restricted to within the range of 9 to 15%.

(C): If the C content exceeds 0.12%, a large amount of carbide is formed, thereby the formability for drawing is inferior, and hence, the C content is restricted to 0.12% or less.

(Si): Si is added for deoxidation. If the Si content is less than 0.005%, the effect as a deoxidizer cannot be obtained. On the other hand, if the Si content exceeds 1.0%, the formability is inferior. Hence, the Si content is restricted to within the range of 0.005 to 1.0%.

(Mn): Mn is added for deoxidation and formation of MnS. If the Mn content is less than 0.005%, these effects are not expected. If the Mn content exceeds 2.5%, the hardness of the alloy increases, thereby the formability for drawing is inferior. Hence, the Mn content is restricted to within the range of 0.005 to 2.5%.

(P): If the P content exceeds 0.03%, the formability for drawing is inferior. Hence, the P content is restricted to 0.03% or less.

(S): When S is contained in an appropriate amount, S forms MnS together with Mn, so that the forming of burrs is inhibited in press punching a hole and cracks in burring is inhibited. If the S content is less than 0.0003%, such effects are not expected. If the S content exceeds 0.0100%, coarse MnS is formed, thereby the formability for drawing is inferior. Hence, the S content is restricted to within the range of 0.0003 to 0.0100%.

(Mo): Since Mo improves corrosion resistance, Mo can be advantageously added when special corrosion resistance is required. However, if the Mo content exceeds 2.0%, the formability for drawing is inferior. Hence, the Mo content is restricted to 2.0% or less.

(Al): Al is added for deoxidation, which is effective with an Al content of 0.001% or more. If the Al content exceeds 0.2%, the formability for drawing is inferior. Hence, the Al content is restricted to within the range of 0.001 to 0.2%.

(O): When an exceeding large amount O is contained, the amount of oxide-type inclusions increase, thereby the formability for drawing is inferior. Hence, the O content is restricted to 0.003% or less.

(N): When the N content exceeds 0.1%, the formability is inferior. Hence, the N content is restricted to 0.1% or less.

(Ti): Ti forms carbides, sulfides, oxides and nitrides, thereby the formability for drawing is inferior. Hence, the Ti content is restricted to 0.1% or less. A more preferable range for the Ti content is 0.02% or less.

(Nb): Nb forms carbides, sulfides, oxides and nitrides, thereby the formability for drawing is inferior. Hence, the Nb content is restricted to 0.1% or less. More preferable range of the Nb content is 0.02% or less.

(V): V forms carbides and nitrides, thereby the formability for drawing is inferior. Hence, the V content is restricted to 0.1% or less. A more preferable range for the V content is 0.02% or less.

(Zr): Zr forms oxides, thereby the formability for drawing is inferior. Hence, the Zr content is restricted to 0.1% or less. A more preferable range for the Zr content is 0.02% or less.

(Ca): Ca forms sulfides and oxides, thereby the formability for drawing is inferior. Hence, the Ca content is restricted to 0.05% or less. A more preferable range for the Ca content is 0.01% or less.

(Mg): Mg forms oxides, thereby the formability for drawing is inferior. Hence, the Mg content is restricted to 0.02% or less. A more preferable range for the Mg content is 0.005% or less.

The inventors have found that the formability for drawing is inferior when the difference is large between the rolling direction and the transverse direction to the rolling direction in a horizontal cross section in the surface of the material. In particular, the inventors have paid attention to root mean square inclination of the profile of the horizontal cross section, which shows the standard deviation in the inclination of the slant between the ridges and valleys on the surface of the material. The inventors demonstrated the difference between the rolling direction and the transverse direction to the rolling direction in a profile of the horizontal cross section, as a ratio of the root mean square inclination $\Delta q$ in the rolling direction and the root mean square inclination $\Delta q$ in the transverse direction to the rolling direction. They have studied the relationship between the ratio and the formability for drawing. As a result, they found that when the large value is obtained by dividing the root mean square inclination in the rolling direction with the root mean square inclination in the transverse direction to the rolling direction, the difference between lubricating properties in both directions is large, and the formability for drawing is inferior. The root mean square inclination $\Delta q$ is shown by the following formula (3).

$$\Delta q=\{\Sigma(\Delta y/\Delta x)^2/N\}^{1/2} \quad (3)$$

Wherein $\Delta y$ is the vertical increase with respect to a horizontal small deviation.

According to research by the inventors, when the root mean square inclination in the rolling direction and the root mean square inclination in the transverse direction to the rolling direction in the surface roughness of the material are respectively defined as $\Delta q_0$ and $\Delta q_{90}$, it has been demonstrated that if $\Delta q_0/\Delta q_{90}$ is larger than 4, the difference between lubricating properties of the rolling direction and the transverse direction to the rolling direction is large, and the formability for drawing is inferior. Therefore, $\Delta q_0/\Delta_0$ is preferably 4 or less.

It should be noted that if the cleanliness based on JIS G0555 of the alloy exceeds 0.03%, the formability for drawing, in particular, the formability for both deep drawing and high burring, is inferior. Therefore, the cleanliness of the alloys should be 0.03% or less.

DETAILED DESCRIPTION OF THE INVENTION

Preferred embodiments of the invention will be described hereinafter.

In order to obtain the above-mentioned kurtosis and the root mean square inclination in a horizontal cross section, a material subjected to the final rolling into the required thickness may be mechanically polished with a fabric containing abrasives or SiC powder having various grain sizes. Alternatively, the kurtosis and the root mean square inclination in a horizontal cross section may be controlled by selecting the surface roughness of the matte roll used in the finish rolling.

EXAMPLE

The present invention will now be described in further detail in connection with its working examples and comparative examples. The chemical compositions of sample materials are shown in Table 1. The sample materials were melted and cast into ingots. The ingots were subjected to blooming, peeling, hot rolling, and descaling, and were repeatedly cold rolled and annealed to form 0.4 mm thick annealed sheets. Continuous casting may be performed for casting to obtain a slab, and forging may be performed instead of blooming. Chemical compositions outside the ranges of the invention are underlined in Table 1.

The surfaces of the annealed sheets were mechanically polished with fabrics containing abrasives and SiC powder having various grain sizes. The finish rolling before annealing was performed with several kinds of matte rollers having various surface roughnesses, whereby materials having various surface roughnesses were produced. The grain size of the abrasive and the center-line mean roughness (Ra) of the surface of the matte roller are shown in Table 2. A deep drawing test by press forming was performed on the annealed sheet. The limiting draw ratio of the annealed sheet was measured. A water-soluble wax was used in press forming for a lubricant. The sheet specimen was drawn with a punch for a flat sheet at a drawing ratio of 1.33, and the worked specimen was evaluated as to whether or not cracks were formed therein. The results of the measurement of the surface roughness and evaluation of the press formability are also shown in Table 2.

TABLE 1

| | Cr | Ni | C | Si | Mn | P | S | Mo | Al | O | N | Ti | Nb | V | Zr | Ca | Mg | Fe | Remarks |
|---|---|---|---|---|---|---|---|---|---|---|---|---|---|---|---|---|---|---|---|
| Component A | 16.1 | 14.5 | 0.05 | 0.6 | 1.5 | 0.022 | 0.0026 | 0.01 | 0.004 | 0.0022 | 0.035 | 0.002 | 0.002 | 0.001 | 0.001 | 0.001 | 0.001 | Bal. | Example of the Invention |
| Component B | 16.0 | 13.7 | 0.05 | 0.5 | 1.2 | 0.023 | 0.0152 | 0.02 | 0.003 | 0.0025 | 0.037 | 0.003 | 0.001 | 0.002 | 0.002 | 0.001 | 0.001 | Bal. | Comparative Example |
| Component C | 17.1 | 13.8 | 0.06 | 0.5 | 1.7 | 0.015 | 0.0022 | 0.01 | 0.003 | 0.0028 | 0.042 | 0.003 | 0.51 | 0.001 | 0.002 | 0.002 | 0.001 | Bal. | |
| Component D | 16.5 | 14.2 | 0.06 | 0.5 | 1.5 | 0.023 | 0.0025 | 0.01 | 0.001 | 0.0052 | 0.039 | 0.003 | 0.002 | 0.001 | 0.002 | 0.002 | 0.001 | Bal. | |

TABLE 2

| | No. | Chemical Composition | Surface Roughness $Kr_0$ | $Kr_{90}$ | $\Delta q_0$ | $\Delta q_{90}$ | $\Delta q_{90}/\Delta q_0$ | Formabity: Limiting Draw Ratio | Formabity: Crack in Drawn Portion | Roughness of Abrasive | Center-Line Mean Roughness of Surface of Matte Roll (μm) | Cleanliness (%) |
|---|---|---|---|---|---|---|---|---|---|---|---|---|
| Example of the Invention | 1 | A | 2.97 | 3.48 | 0.0229 | 0.0734 | 3.21 | 2.38 | None | Equivalent to #320 | 0.29 | 0.016 |
| | 2 | A | 3.47 | 3.72 | 0.0189 | 0.0725 | 3.83 | 2.32 | None | Equivalent to #320 | 0.32 | 0.016 |
| | 3 | A | 2.64 | 3.08 | 0.0287 | 0.0654 | 2.28 | 2.41 | None | Equivalent to #320 | 0.25 | 0.016 |
| | 4 | A | 3.59 | 3.78 | 0.0265 | 0.0972 | 3.67 | 2.35 | None | Equivalent to #240 | 0.30 | 0.016 |
| | 5 | A | 3.12 | 3.65 | 0.0145 | 0.0749 | 5.17 | 2.27 | None | Equivalent to #240 | 0.25 | 0.016 |
| Comparative Example | 6 | A | 4.34 | 4.67 | 0.0128 | 0.0972 | 7.59 | 2.19 | Present | Non-Polishing | 0.40 | 0.016 |
| | 7 | A | 3.82 | 5.13 | 0.0247 | 0.0725 | 2.94 | 2.22 | Present | Equivalent to #320 | 0.70 | 0.016 |
| | 8 | B | 3.37 | 3.64 | 0.0218 | 0.0698 | 3.20 | 2.18 | None | Non-Polishing | 0.25 | 0.021 |
| | 9 | B | 4.23 | 5.46 | 0.0178 | 0.0845 | 4.74 | 2.05 | None | Equivalent to #400 | 0.30 | 0.021 |
| | 10 | C | 2.78 | 3.48 | 0.0159 | 0.0789 | 4.96 | 1.97 | None | Non-Polishing | 0.31 | 0.025 |
| | 11 | C | 4.53 | 4.94 | 0.0128 | 0.0889 | 6.95 | 2.10 | Present | Non-Polishing | 0.55 | 0.025 |
| | 12 | D | 3.42 | 3.65 | 0.0255 | 0.0723 | 2.83 | 2.01 | Present (Many) | Equivalent to #320 | 0.32 | 0.037 |

As is seen in Table 2, in all of Examples Nos. 1 to 5 of the present invention, the limiting draw ratio was large and exhibited superior formability for drawing in comparison with in Comparative Examples Nos. 6 to 12. Among these Examples, although Example No. 5 relates to an aspect in which only Kr is limited, the limiting draw ratio thereof was relatively low since it does not covers claim 2 in which Kr and $\Delta q_0/\Delta q_{90}$ are limited. In Examples Nos. 6 and 7, although the chemical composition is in the range of the invention, fine cracks were observed in the drawn surface since one or both of $Kr_0$ and $Kr_{90}$ exceeded 4. In Comparative Examples Nos. 8 to 11, all of the limiting draw ratios were low since the chemical compositions were outside the ranges of the invention. In Comparative Example No. 11 in which Kr exceeded 4, cracks were observed in the drawn surface. In Comparative Example No. 12, cracks were frequently occurred in the drawn surface since the chemical composition exceeded the range of the invention and the cleanliness of the alloy, based on JIS G0555, exceeded 0.03%.

As is explained in the above, since the kurtosis of the rolling direction and the transverse direction to the rolling direction in surface roughness of the material is 4 or less in the Fe—Cr—Ni alloy of the invention, the formability for drawing can be greatly improved and cracks do not readily occur in the press forming under severe conditions. Thus, the invention can provide alloy materials which are optimal for electron gun electrodes.

What is claimed is:

1. An Fe—Cr—Ni alloy for electron gun electrodes comprising: 15 to 20% Cr; 9 to 15% Ni; 0.12% or less C; 0.005 to 1.0% Si; 0.005% to 2.5% Mn; 0.03% or less P; 0.0003 to 0.0100% S; 2.0% or less Mo; 0.001 to 0.2% Al; 0.003% or less O; 0.1% or less N; 0.1% or less Ti; 0.1% or less Nb; 0.1% or less V; 0.1% or less Zr; 0.05% or less Ca; 0.02% or less Mg; and the balance Fe and inevitable impurities by weight, and the alloy having a surface roughness satisfying the following formula when kurtosis in the rolling direction and kurtosis in the transverse direction to the rolling direction in surface roughness of the alloy are respectively defined as $Kr_0$ and $Kr_{90}$ $$Kr_0 \leqq 4,\ Kr_{90} \leqq 4.$$

2. An Fe—Cr—Ni alloy for electron gun electrodes according to claim 1, wherein the alloy satisfies following formula and the alloy having a surface roughness satisfying the following formula when the root mean square inclination in the rolling direction and the root mean square inclination in the transverse direction to the rolling direction in the surface roughness of the alloy are respectively defined as $\Delta q_0$ and $\Delta q_{90}$ $\Delta q_{90}/\Delta q_0 \leqq 4$.

3. An Fe—Cr—Ni alloy for electron gun electrodes according to claim 1, wherein the alloy has a cleanliness of 0.03% or less based on JIS G0555.

4. An Fe—Cr—Ni alloy for electron gun electrodes according to claim 1, wherein the Cr content is in a range of 15 to 17% by weight.

5. An Fe—Cr—Ni alloy for electron gun electrodes according to claim 1, wherein the content of at least one of Ti, Nb, V, and Zr is restricted to 0.02% or less by weight.

6. An Fe—Cr—Ni alloy for gun electrodes according to claim 1, wherein the Ca content is restricted to 0.01% or less by weight.

7. An Fe—Cr—Ni alloy for electron gun electrodes according to claim 1, wherein the Mg content is restricted to 0.005% or less by weight.

* * * * *